US006531650B1

(12) United States Patent
Chen

(10) Patent No.: US 6,531,650 B1
(45) Date of Patent: Mar. 11, 2003

(54) MUSICAL TOY WITH ELECTRICAL GENERATOR

(75) Inventor: Ting-Hsing Chen, Tainan Hsien (TW)

(73) Assignee: Far Great Plastics Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 10/135,520

(22) Filed: May 1, 2002

(51) Int. Cl.[7] ..... G01F 1/06

(52) U.S. Cl. ..... 84/94.1; 84/94.2; 84/95.1; 84/95.2

(58) Field of Search ..... 446/298, 297, 446/299, 267, 268; 84/94.1, 94.2, 95.1, 95.2, 96, 97, 98, 99, 100

(56) References Cited

U.S. PATENT DOCUMENTS

| | | | | | |
|---|---|---|---|---|---|
| 4,890,528 | A | * | 1/1990 | Kamijima | 84/95.2 |
| 5,314,365 | A | * | 5/1994 | Chen | 446/133 |
| 5,430,239 | A | * | 7/1995 | Chen | 84/95.2 |
| 5,523,523 | A | * | 6/1996 | Chen | 84/95.2 |

* cited by examiner

*Primary Examiner*—Kim Lockett
(74) *Attorney, Agent, or Firm*—Rosenberg, Klein & Lee

(57) ABSTRACT

A musical toy with electrical generator is composed a base, a musical set, a string roll, and a cover. The musical set comprises a coil base with a coil at the bottom portion, and a magnet on a spindle of the musical set. When the spindle spins, the magnet spins simultaneously with respect to the coil, thus generates electrical power to activate lighting devices.

3 Claims, 5 Drawing Sheets

MUSICAL TOY WITH ELECTRICAL GENERATOR

BACKGROUND OF THE INVENTION

1. Field of the Invention

This invention relates to a musical toy, more particular to a toy with self-electrical generator to generate electrical power to drive the musical instrument.

2. Description of the Prior Art

A musical toy currently on the market, as shown in FIG. 1, comprises a spiral spring 12 linked to a spindle 11, whereas by pulling a pulling ring 10, the spindle 11 spins to compress the spiral spring 12, when releasing the pull ring 10, the restoring force of the spiral spring 12 rotates the spindle 11 to link a gear box 13 to activate a sound device 14 to broadcast sounds, thus attracts a user's attention. A later device is to install lighting devices, which requires a battery 16 and a switch 17 to operate its function, which device has increased cost and makes the structure complicated.

In view of this and many other shortcomings, the inventor has derived the present invention.

SUMMARY OF THE INVENTION

It is the primary object of the present invention to provide a self-electric power generator to activate the lighting devices of the toy.

It is another object of the present invention to provide a self-electric power generator, which uses mechanic movement to generate electric power, thus saves energy.

It is a further object of the present invention to provide a self-electric power generator, which is easy to install and safe in use.

DETAILED DESCRIPTION OF THE PREFERRED EMBODIMENT

Figure 1:
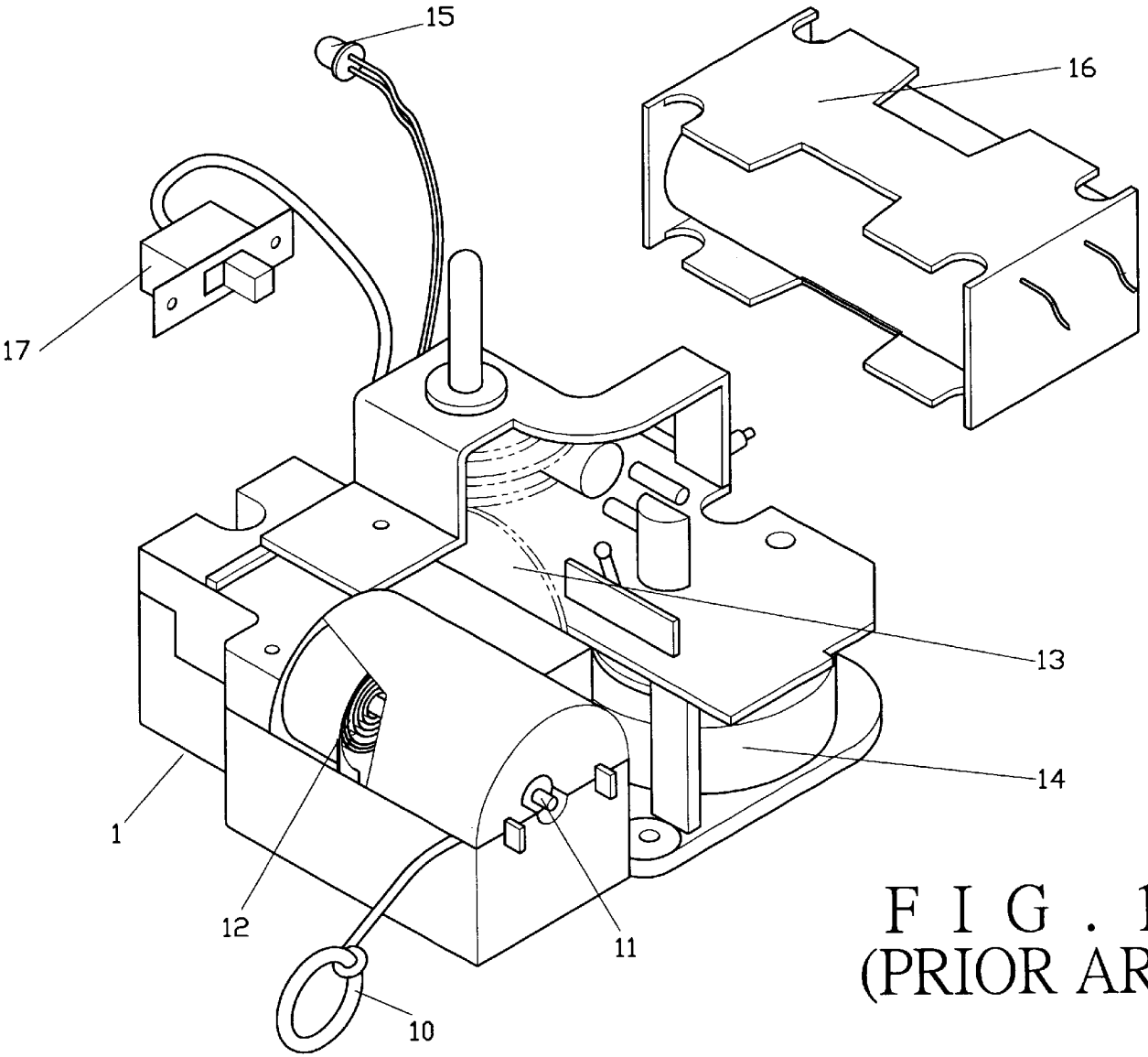
FIG. 1 (PRIOR ART)
FIG. 1 is a perspective view of a musical set for a toy of a prior art.
Figure 2:
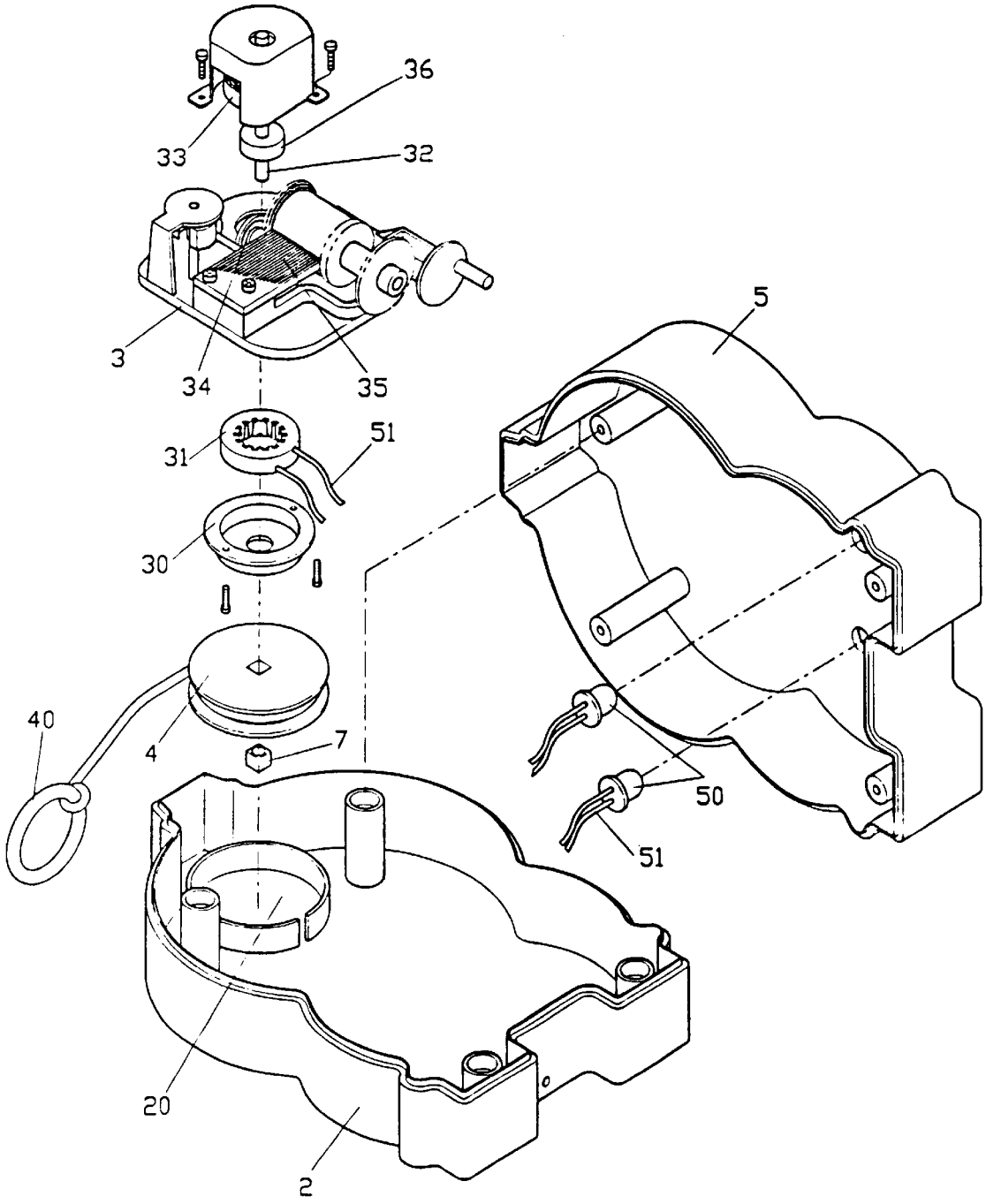
FIG. 2 is an exploded view of the present invention.

The present invention comprises a base 2 having a fixture 20 therein, a musical set 3, a string roll 4, and a cover 5.

The musical set 3 comprises a coil base 30 at the bottom portion to receive a coil 31 therein, a spindle 32, a spiral spring 33 on the top portion of the spindle 32, a gear set 34 meshing with the spindle 32, a sound device 35 linked to the gear set 34. The bottom portion of the spindle 32 provides a magnet 36 located in the coil 31.

The string roll 4 having a pulling ring 41 is located at the bottom end of the spindle 32. The cover 5 is shaped to cover the base 2 and comprises a plurality of lighting devices 50 which are formed of either light bulbs or light-emitting diodes. Each of the lighting devices 50 is connected to the coil 31 through electric wires 51.

Figure 3:
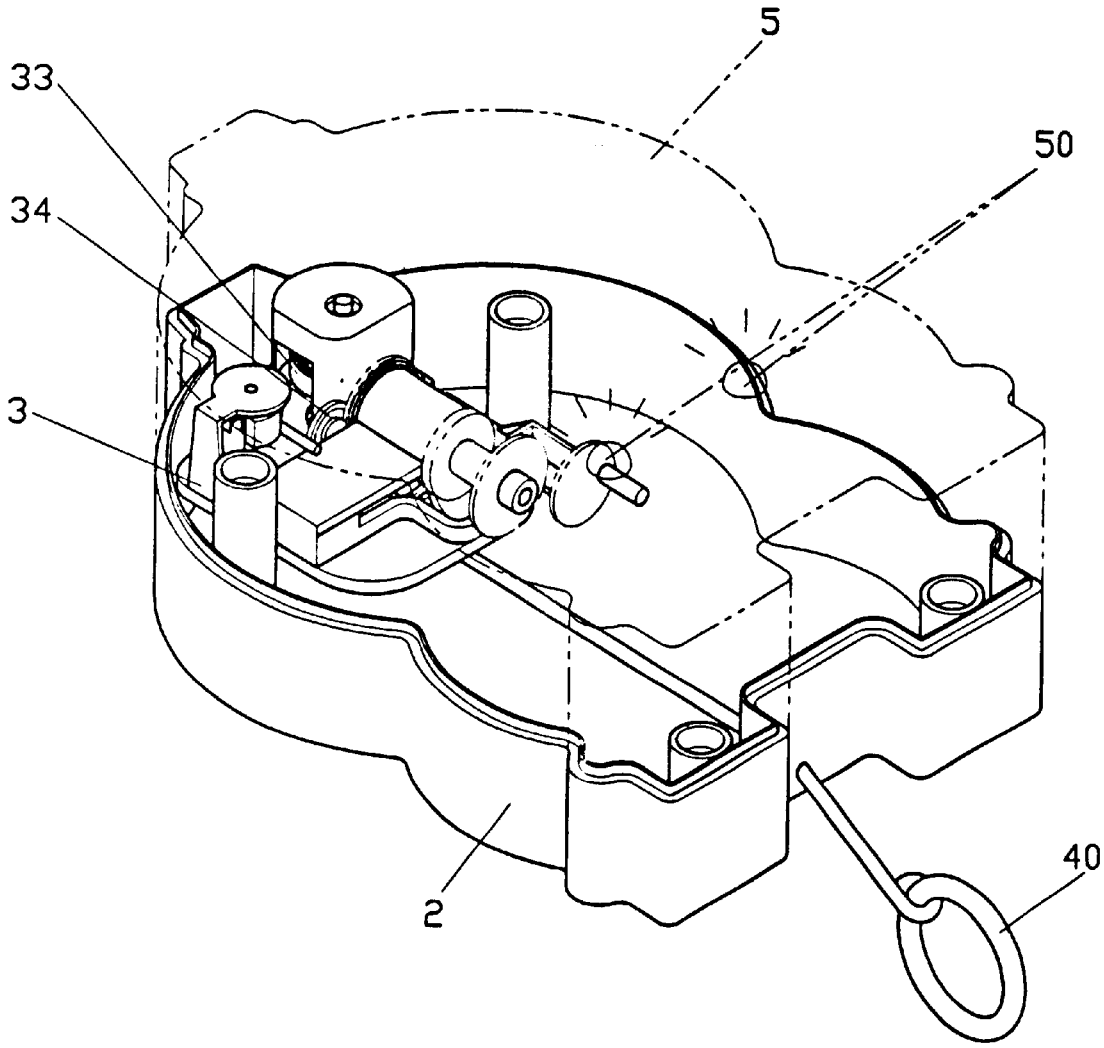
FIG. 3 is a perspective view of the present invention.

To assemble the present invention, as shown in FIG. 3, the string roll 4 is threaded to the spindle 32 of the musical set 3 with a nut 7, the musical set 3 is secured to the fixture 20 of the base 2, and the base 2 is sealed with the cover 5. This completes the assembly of the present invention.

Figure 4:
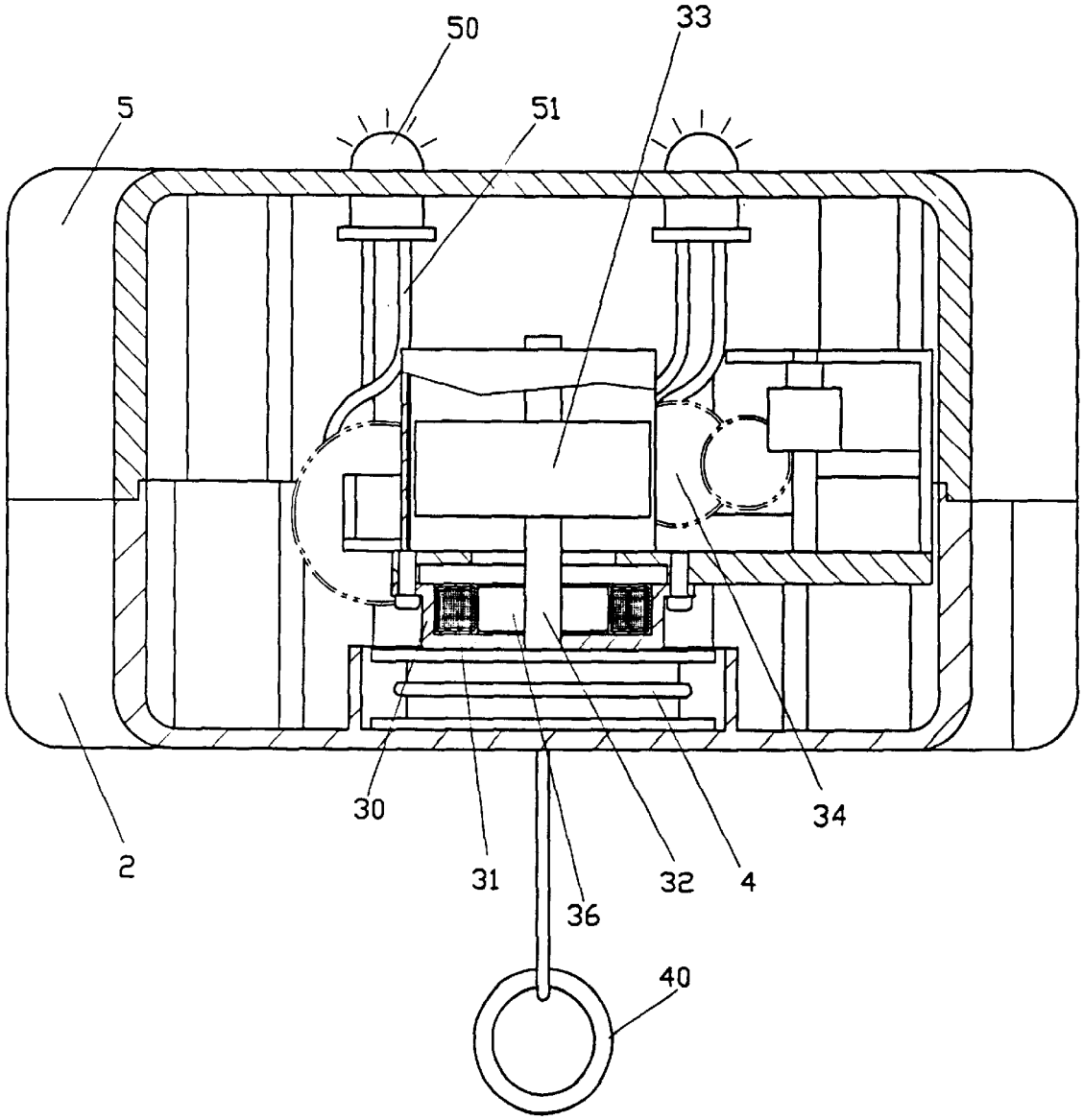
FIG. 4 is a sectional view of a first embodiment of the musical set of the present invention.

To operate the present invention, as shown in FIG. 4, the pulling ring 41 is pulled to roll the string roll 4, which brings the spindle 32 to compress the spiral spring 33. Upon releasing the pulling ring 41, the restoring force of the spiral spring 33 rotates the spindle 32 to bring the gear set 34, thus activates the sound device 35 to sound. When the spindle 32 spins, the magnet 36 on the spindle 32 rotates simultaneously with respect to the coil 31, which generates electric power and activates the lighting devices 50 through electric wires 51.

Figure 5:
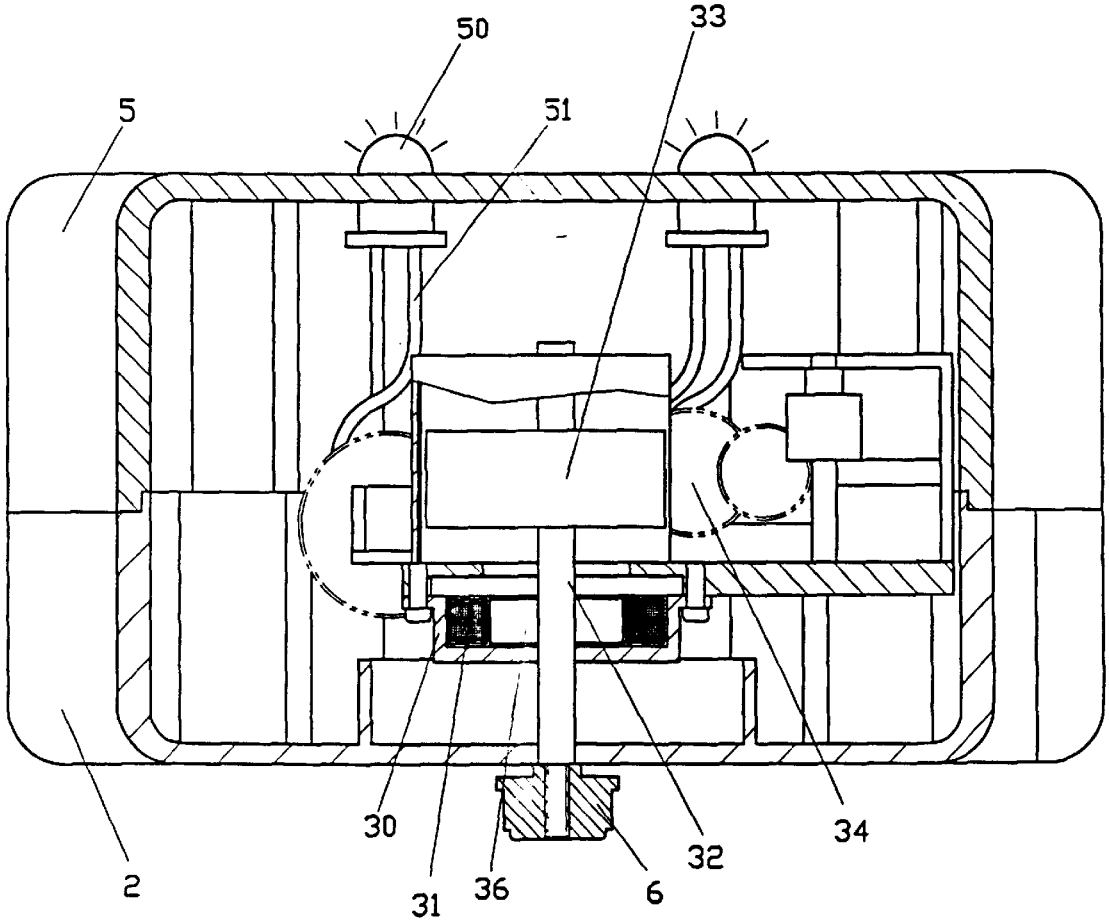
FIG. 5 is a sectional view of a second embodiment of the musical set of the present invention.

Another embodiment is derived, as shown in FIG. 5, a knob 6 is formed on the spindle 32 of the musical set 3 to replace the string roll 4, which drives the spindle 32 to rotate, thus produces lovely sound through the sound device 35 and lighting effect through the lighting devices 50.

I claim:

1. A musical toy with electric generator comprising a base having a fixture therein, a musical set secured to said fixture of said base, said musical set comprising a spindle with a spiral spring on the top portion, and a coil base at the bottom portion thereof, said spindle being meshed with a gear set and linked with a sound device, a string roll located at the end of said spindle, and comprising a pulling ring, a cover being shaped to cover said base, and comprising a plurality of lighting devices, and being characterized in that:

said musical set having the coil base with a coil at the bottom portion thereof, said coil being connected to said lighting devices through electric wires, a magnet being secured near the bottom portion of said spindle and located in said coil of said coil base, thus when rotating said spindle, said magnet rotates simultaneously, and in an opposing direction with respect to said coil, thus generating electric power and supplied to said lighting devices.

2. The musical toy with electric generator, as recited in claim 1, wherein said spindle of said musical set comprises a knob to replace said string roll.

3. The musical toy with electric generator, as recited in claim 1, wherein said lighting devices are light bulbs or light-emitting diodes.

* * * * *